United States Patent [19]

Lonardi et al.

[11] Patent Number: 5,022,806

[45] **Date of Patent: * Jun. 11, 1991**

[54] APPARATUS FOR CHARGING A SHAFT FURNACE

[75] Inventors: Emile Lonardi, Bascharage; Giovanni Cimenti, Fentange; Pierre Mailliet, Howald, all of Luxembourg

[73] Assignee: Paul Wurth S.A., Luxembourg

[ * ] Notice: The portion of the term of this patent subsequent to Jul. 17, 2007 has been disclaimed.

[21] Appl. No.: 410,713

[22] Filed: Sep. 21, 1989

[30] Foreign Application Priority Data

Sep. 22, 1988 [LU] Luxembourg ..... 87341

[51] Int. Cl.[5] ..... F23K 3/18

[52] U.S. Cl. ..... 414/208; 414/299; 414/302; 414/588; 239/659; 239/687; 266/199

[58] Field of Search ..... 414/150, 152, 153, 160, 414/170, 172, 179, 182, 193, 195, 196, 204, 205, 206, 207, 208, 287, 299, 300, 301, 302, 586, 587, 588; 239/659, 681, 687; 266/197, 199; 432/96, 98

[56] References Cited

U.S. PATENT DOCUMENTS

| | | | |
|---|---|---|---|
| 2,859,862 | 11/1958 | Best | 239/659 X |
| 3,814,403 | 6/1974 | Legille | 414/208 |
| 3,899,088 | 8/1975 | Furuya et al. | 414/206 |
| 3,921,831 | 11/1975 | Takahashi et al. | 414/206 |
| 4,360,305 | 11/1982 | Dorsch | 414/208 |
| 4,368,813 | 1/1982 | Mailliet | 414/160 X |
| 4,493,600 | 1/1985 | Legille et al. | 414/208 |
| 4,729,549 | 3/1988 | Lonardi et al. | 414/207 X |
| 4,941,792 | 7/1990 | Cimenti et al. | 414/208 |

FOREIGN PATENT DOCUMENTS

| | | | |
|---|---|---|---|
| 1301843 | 4/1987 | U.S.S.R. | 266/199 |

*Primary Examiner*—Robert J. Spar
*Assistant Examiner*—John VandenBosche
*Attorney, Agent, or Firm*—Fishman, Dionne & Cantor

[57] ABSTRACT

The present invention relates to an apparatus for charging a shaft furnace. The apparatus includes a rotary and pivoting distributor chute suspended on the head of the furnace, a device for driving this chute, which consists of a first and second running ring designed respectively for rotating the chute about the vertical axis of the furnace and for changing its inclination relative to this axis as a result of a pivoting about its horizontal suspension axis, and a device for actuating the two running rings independently of one another, a central charging lock equipped with upper and lower sealing flaps and with a metering and closing valve for adjusting the flow of material from the lock on to the distributor chute, and a device for filling the lock.

15 Claims, 7 Drawing Sheets

37
40
35
33
31
30
22
24

20
42
36
38
40
30
18
14
12
10
0
16

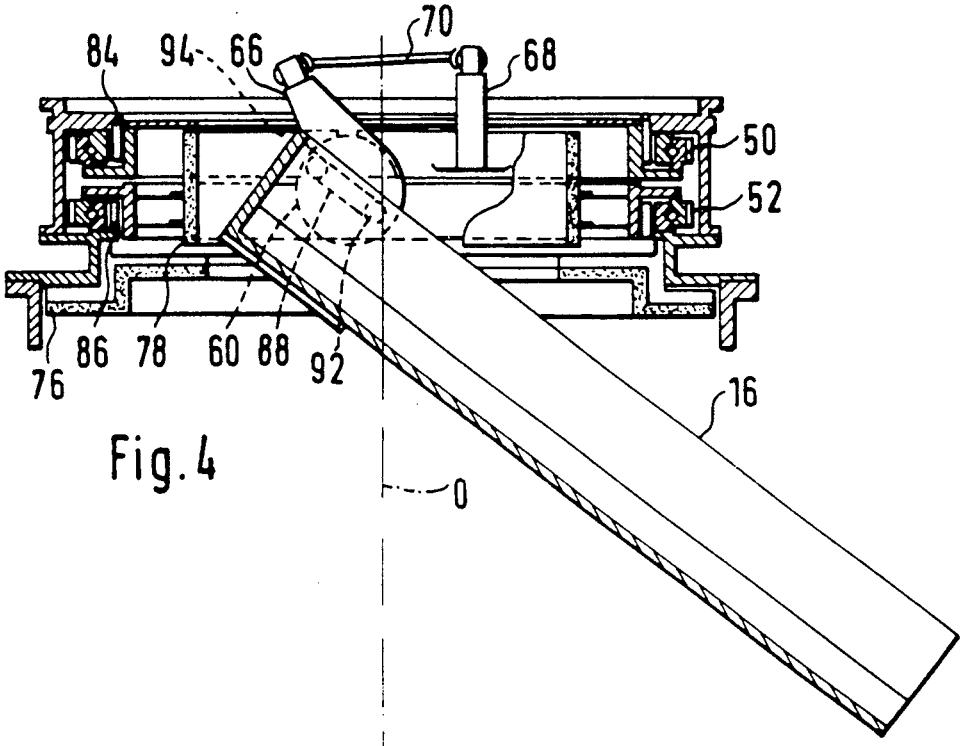
Fig. 4
Fig. 5
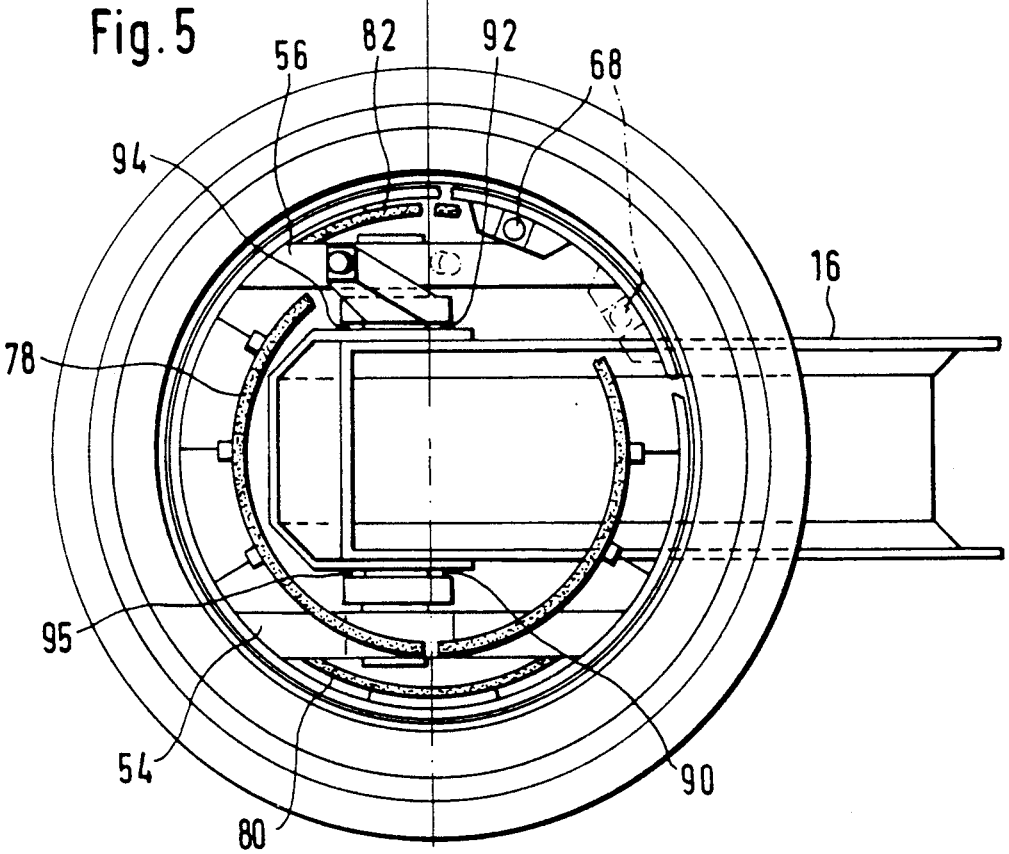

APPARATUS FOR CHARGING A SHAFT FURNACE

TECHNICAL FIELD

The present invention relates to shaft furnaces and more particularly to devices for charging shaft furnaces.

BACKGROUND OF THE INVENTION

U.S. Pat. No. 3,880,302, describes an apparatus for charging a shaft furnace which comprises two locks placed next to one another and operating alternately. This known charging installation is supported by a relatively large framework which is itself carried by a square tower installed round the furnace. The distributor chute is suspended on the diametrically opposed axles of two drive housings revolving round the vertical axis under the action of the first running ring. Each of these housings is connected to the second running ring by means of several pinions and gears, in order to change the inclination of the chute relative to the axis of the furnace. The distributor chute, the inner lining of which has to be regularly renewed, can be replaced by means of a handling device of the type described in the U.S. Pat. No. 4,729,549. According to this patent, the chute is extracted laterally through an orifice made in the upper conical part of the furnace wall.

This charging installation and the mechanism for driving the chute have proved especially effective and advantageous for use on new blast furnaces or for major repairs and since the initial design of this charging installation it has equipped many blast furnaces.

Unfortunately, it has been impossible for this installation of very high performance on blast furnaces of large size, to be adapted with similar success to blast furnaces of smaller size, especially those without a square tower. In this type of furnace, the charging installation and the work platform surrounding it are supported directly by the all of the furnace. Unless reinforcements are provided beforehand as a result of major costly conversions, it is therefore impossible to dismount the distributor chute in the way proposed in the above mentioned document, since an orifice cannot be made in the furnace wall and in the work platform to avoid reducing their stability and resistance.

To avoid having to pierce the wall of the furnace in order to dismount the chute, Luxembourg Patent Application No. 87,219 (copending commonly assigned U.S. patent application, Ser. No. 382,517, filed July 19, 1989, now U.S. Pat. No. 4,941,792), proposed to dismount the chute upwards through the casing of its drive mechanism. Despite this solution, there is still the problem that the installation is supported by the furnace wall. In fact, it is well known that the furnace wall experiences thermal expansion movements and this consequently has an effect on the casing of the drive mechanism of the chute, this therefore being exposed to risks of deformation. Now the drive mechanism known from U.S. Pat. No. 3,880,302, comprising a complex system of gears and pinions, especially in the region of the two rotary housings generating the pivoting of the chute, does not tolerate deformations of this extent.

Moreover, when a conventional bell-type charging device of an existing furnace is to be replaced by a modern charging apparatus with a rotary distributor chute, the problem of availability of space arises. In fact, the new apparatus has to be arranged between the supporting collar of the lower bell and the installation for raising the charging material, this usually being a skip transporter. Unfortunately, this available space is often very limited and it is therefore difficult to provide a charging installation of the above described type in it.

SUMMARY OF THE INVENTION

The object of the present invention is to provide a new installation for charging a shaft furnace, which is equally suitable for blast furnaces of small and medium size, particularly as a replacement of a conventional bell-type charging installation.

To achieve this object, the present invention proposes an installation of the type described in the pre-characterizing clause, which is characterized essentially in that the distributor chute is supported pivotably between and by two horizontal crossmembers extending in parallel on either side of the chute, on the inside of the said first ring and fastened directly to the latter, and in that the chute is connected to the said second ring by means of an articulated linkage.

Because the two running rings are mounted coaxially one above the other and the chute is suspended between these two rings, the overall height of the drive mechanism is reduced virtually to the sum of the thickness of these two rings. This decrease in total height of the drive mechanism consequently correspondingly reduces the total height of the charging installation and makes it easier to arrange it in the available space between the furnace head and the transporters for the charging material.

Moreover, the small height of the mechanism for driving the chute makes it easier to dismount the latter upwards through the valve cage.

The angular adjustment of the distributor chute is obtained by means of the linkage under the action of a relative movement between the two running rings. Such a linkage withstands deformations of the casing of the drive mechanism better than the known transmissions with gears and pinions.

The chute is supported dismountably by two lateral flanges, each possessing a supporting journal seated respectively in a bearing of each of the said crossmembers.

The suspension and orientation of the chute can be obtained by means of two pairs of pins fastened to the outer wall of the chute and engaged by sliding into two corresponding grooves which are provided respectively in the inner faces of each of the flanges and in which the chute is retained as a result of its own weight.

The grooves and pins can be profiled and associated with a locking device, in order to prevent the chute from being disconnected accidentally.

The linkage connecting the chute to the second running ring consists of a first arm integral with one of the flanges, of a second arm integral with the second running ring and of a link articulated on the free ends of each of the said arms.

This new mechanism for driving the chute is especially suitable for an efficient cooling of the most vulnerable parts. In particular, the device can have an annular thermal protection shield fastened underneath the drive means and connected to a cooling-fluid circuit, and cylindrical thermal protection segments fastened to the inside of the first running ring and extending over the height of the two rings, at least over most of the circumference.

Furthermore, each of the running rings can be associated with a cylindrical thermal protection screen connected to a cooling-fluid circuit.

The two crossmembers for the suspension of the chute ca likewise be cooled. For this purpose, each of these can be designed in the form of a hollow box integrated into a circuit for cooling by evaporation, which comprises two circular conduit segments fastened to the first running ring and subjected to the action of a cooling means. The latter can consist of a ring of outer radial blades on the said conduit and a second ring of inner radial blades fastened round the said first ring on the inner wall of the casing in which the running rings are mounted.

According to a first embodiment, the lower sealing flap of the lock is mounted in valve cage forming a unit with the lock and the casing containing the drive means of the chute, this unit being carried by an annular support closing the upper part of the furnace.

According to a second embodiment, the lock is supported by the furnace head by means of load cells and an intermediate framework, while it is connected by means of compensators to an underlying valve cage which forms a unit with the casing containing the drive means.

The above-discussed and other features and advantages of the present invention will be appreciated and understood from the following detailed description and drawings.

BRIEF DESCRIPTION OF THE DRAWINGS

Referring now to the drawings, wherein like elements are numbered alike in the several FIGURES:

FIG. 4 is a view similar to that of FIG. 3 in a sectional plane perpendicular relative to this;

FIG. 5 is a plan view of the representation of FIG. 4;

DETAILED DESCRIPTION OF THE INVENTION

Figure 1:
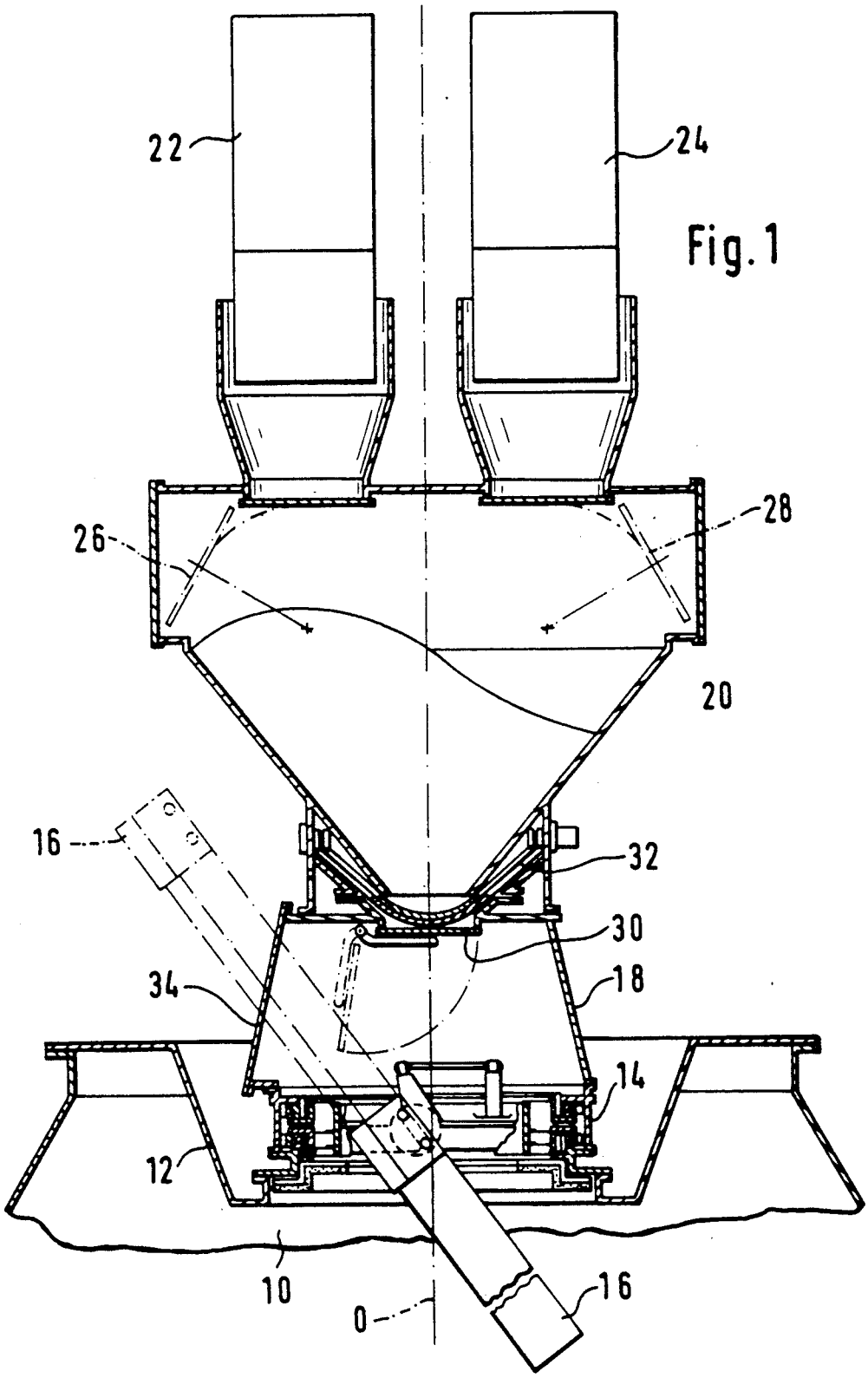
FIG. 1 is a diagrammatic view in vertical section of a first embodiment of a charging installation in accordance with the present invention.

FIG. 1 illustrates the head of a blast furnace 10, in which a conventional bell-type charging installation has been replaced by a first embodiment of a charging installation according to the present invention. The reference 12 denotes a supporting collar in the form of a hollow dish, serving to match to the new installation the annular edge which before served as a support for the lower bell and which now serves as a support for the entire charging installation.

The charging installation consists, from the bottom upwards of a casing 14 fastened in the recess of the support 12 and containing the mechanism for driving a rotary distributor chute 16 of variable angle of adjustment of a valve cage 18 of a central charging lock 20 and of an installation for raising the charging material consisting in this particular case of two skip transporters 22 and 24. These two skip transporters 22 and 24 formed part of the prior charging installation according to the present invention must be designed to be arranged between these skip transporters 22, 24 and the support collar 12.

The charging lock 20 communicating alternately with the atmosphere and the interior of th furnace is equipped with one or, in the example shown, with two upper sealing flaps 26 and 28 and with a lower sealing flap 30 which is located in the valve cage 18. The flow of charging materials from the lock 20 is adjusted by means of a metering valve 32 which acts symmetrically about the vertical axis 0 and which is known per se. This valve 32 is mounted on the lower part of the wall of the lock 20.

One of the particular features of the charging installation according to the present invention is that it is designed to allow the chute 16 to be dismounted in an oblique upward direction, this being illustrated by the representation of the chute in the form of broken lines. For this purpose, both the mechanism for driving the chute and the valve cage 18 must be designed to allow the passage of the chute 16. To achieve this, the casing 14 of the drive mechanism must be very low, whereas the valve cage 18 must be relatively high. Furthermore, the valve cage 18 possesses a removable cover 34, in order to allow the extraction of the chute 16, and where appropriate, the inspection of the mechanism for driving the chute.

The embodiment of FIG. 1 is characterized in that the lock 20, the valve cage 18 and the casing 14 to form a constructional unit which is supported completely by the dish 12.

Figures 2, 2A:
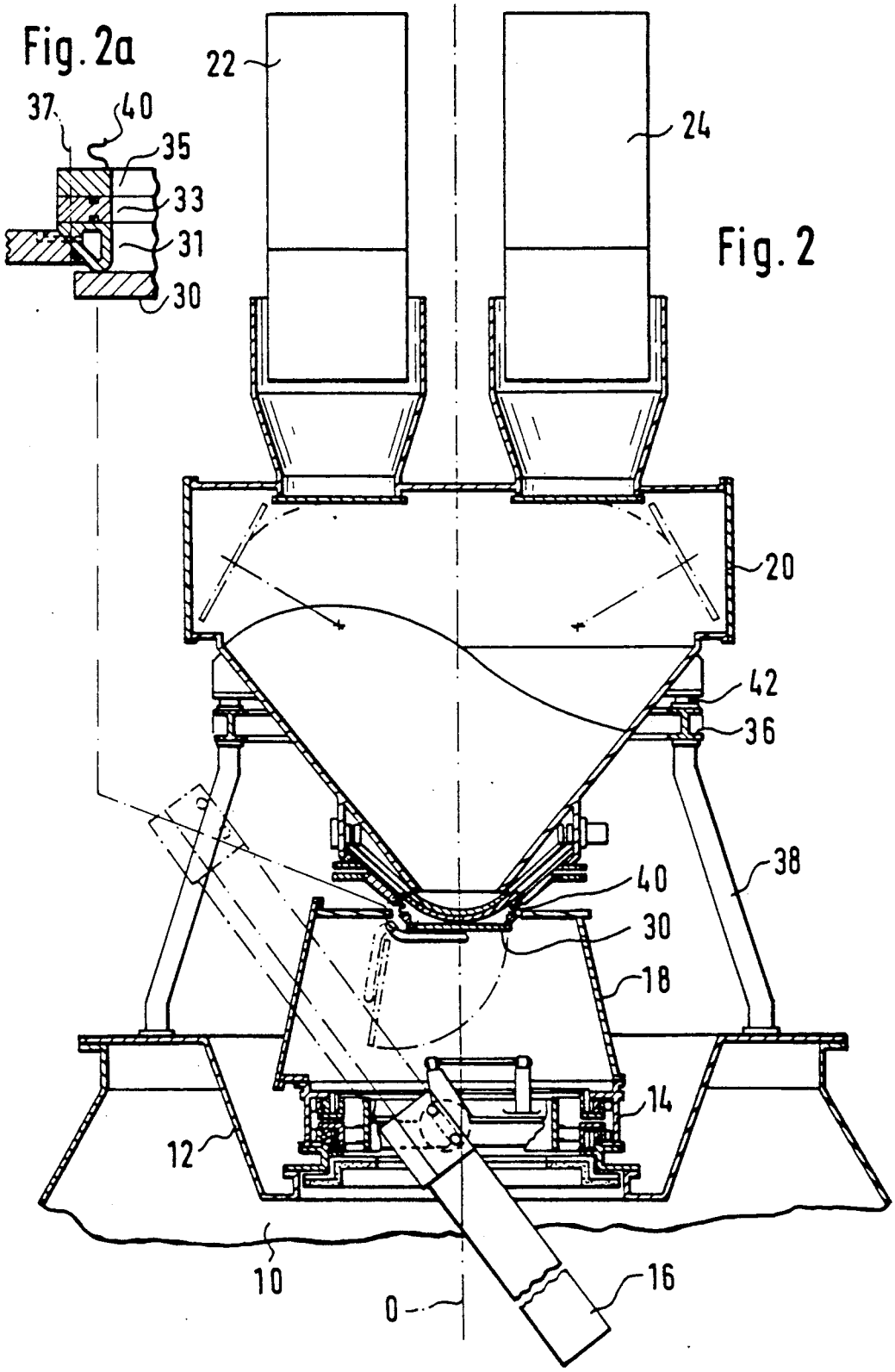
FIG. 2 is a view, similar to that of FIG. 1, of a second embodiment of a charging installation in accordance with the present invention.

The embodiment of FIG. 2 differs from the embodiment of FIG. 1 only in its suspension. In the embodiment of FIG. 2, in fact, the lock 20 is supported by a circular or square girder 36, itself carried by several pillars 38 bearing on the outer edge of the dish 12. The lock 20 can be carried directly by the girder 36 or preferably indirectly be means of load cells 42 which make it possible to monitor the contents of the lock 20. To make it possible to weight this lock 20, it is independent of the valve cage 18, to which it is connected only by a compensator 40 ensuring freedom of vertical movement of the lock, and at the same time, sealing relative to the outside.

In contrast, as in FIG. 1, the valve cage 18 remains fixed to the casing 14, with which it forms a unit carried by the support 12.

FIG. 2A shows an advantageous embodiment of the seat of the lower sealing flap 30 for the purpose of making it easier to dismount it. The annular seat designated by 31, which can be hollow for the circulation of a cooling fluid, is wedged between bevelled orifice in the upper wall of the cage 18 and a sealing collar 33 equipped with upper and lower O-ring gaskets. The reference 35 denotes a bracket to which the compensator 40 is welded. The clamping of the bracket 35, collar 33 and seat 31 can be carried out by means of a set of bolts which are symbolized by the reference 37 and which it is sufficient to slacken and remove in order to release and remove the collar 33 and seat 31 laterally. It is advantageous to design the compensator 40 in such a way that it is tensioned when the bolts 37 are tightened. The slackening of the bolts 37 thus releases the compensator 40 and the loosening of the latter lifts the bracket 35 so as to release the collar 33 and the seat 31.

It should be noted that, since it is not possible to weigh the lock 20 in the embodiment of FIG. 1, the content of the lock 20 can be checked by other means, such as level probes, a check of the flow time, etc.

The mechanism for driving the chute 16 will now be described in more detail by reference to FIGS. 3 to 5. The essential characteristics of this drive mechanism are that it is especially suitable for a low construction, an efficient cooling of its components, easy dismounting of the chute upwards through the valve cage and the use of only a few pinions and gears, consequently tolerating the small deformations caused by the support of the installation and movements of the furnace.

The drive mechanism essentially comprises a first and a second running assembly which consist respectively of two collars 46, 48 fixed to the wall of the casing 14 and of two toothed running rings 50, 52 revolving round the collars 46 and 48 by the agency of known rolling means, such as balls or rollers. The two toothed rings 50, 52 are actuated independently by means of pinions which are not shown and which form part of a drive system making it possible either to rotate the two rings 50, 52 synchronously or to decelerate or accelerate the ring 50 in relation to the ring 52. Such a drive system can consist, for example, of a gear system of the planetary type, as described in U.S. Pat. Nos. 3,880,301 and 4,273,492, the disclosures of which are incorporated herein by reference.

Figure 3:
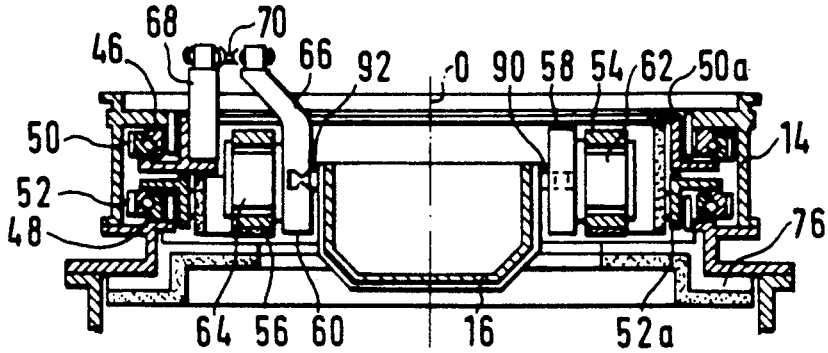
FIG. 3 is a vertical section the details of the mechanism for driving the chute.

As shown in FIGS. 3 and 4, the two running rings 50, 52 have a U-shaped cross-section and are arranged one above the other symmetrically in relation to a horizontal mid-plane. These running rings 50, 52 by means of the hollow portion of their cross-section, are respectively suspended on and carried by the stationary bearing collars 46, 48 the inner branches of their cross-section 50*a*, 52*a* forming coaxial cylindrical collars in alignment with one another.

As shown in FIGS. 3 and 4, two parallel horizontal crossmembers 54, 56 are welded to the inside of the lower running ring 52 at a sufficient distance from the central axis 0 to allow suspension of the chute 16. This chute 16 is suspended by means of two lateral flanges 58, 60, each of these flanges being equipped with an outer journal 62, 64 these being supported pivotably in bearings provided in each of the crossmembers 54, 56. The inclination f the chute 16 relative to the vertical axis 0 (see FIG. 4) can therefore be changed as a result of the pivoting of the journals 62, 64 about their horizontal axle for suspension in the crossmembers 54, 56. The inclination of the chute 16 relative to the vertical inclination of the chute 16 relative to the vertical axis 0 is adjusted under the action of the running ring 50. For this purpose, one of the suspension flanges of the chute, in this particular case the flange 60, is extended upwards by a control arm 66. Another arm 68 is integral with the running ring 50, and the free ends of each of these arms 66, 68 are connected to one another by means of a link 70, the opposite ends of which are articulated on the ends of each of the arms 66, 68 by means of a universal joint, for example a ball-and-socket joint.

When the two running rings 50, 52 are actuated synchronously at the same angular speed, the distributor chute 16 rotates about the axis 0 at a constant inclination, in order to deposit the charging material in circles. In contrast, if, under the action of the planetary drive mechanism, the running ring 50 executes a relative movement in relation to the speed of the ring 50 as a result of acceleration or a reversal of the direction of rotation, it acts by means of the link 70 on the arm 66 and the suspension flange 60 of the chute 16 in order to change the angle of inclination of the chute 16 relative to the vertical axis 0. FIG. 5 shows two different relative positions of the arm 68, one represented by unbroken lines and the other by broken lines. It will be seen that the relative movement of the ring 50 in relation to the ring 52, necessary for tilting the chute 16 between its maximum inclination and its minimum inclination, is very small. This relative movement corresponds approximately to the two positions shown in FIG. 5, that is to say the maximum angular offset of the ring 50 in relation to the ring 52 is of the order of 30°.

This mechanism for driving the chute, because of its simplicity, is especially suitable for an efficient cooling of the most exposed and most vulnerable elements. Thus, most of the drive mechanism is protected from the direct radiation of the furnace by an annular shield 76 (see FIGS. 8 and 9), the central orifice of which is just large enough to allow the chute 16 to rotate within the limits of its angular inclinations. This shield 76 is stationary and can therefore be equipped with internal cooling coils connected to a circuit for a cooling fluid, for example water. Moreover, it can be equipped, on its lower face, with a refractory lining 77.

Figure 8:
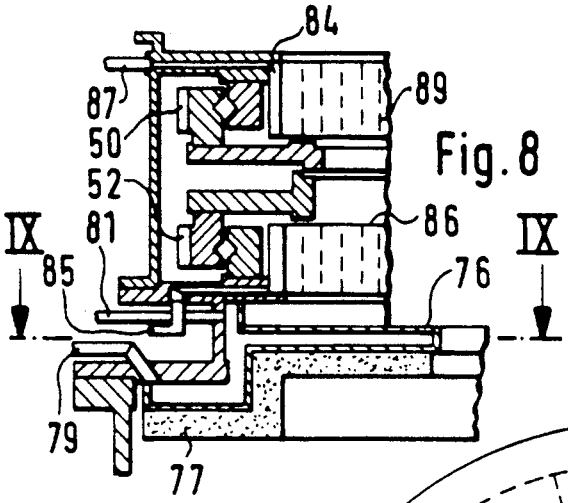
FIG. 8 shows in vertical cross section the details of the cooling of the running rings.
Figure 9:
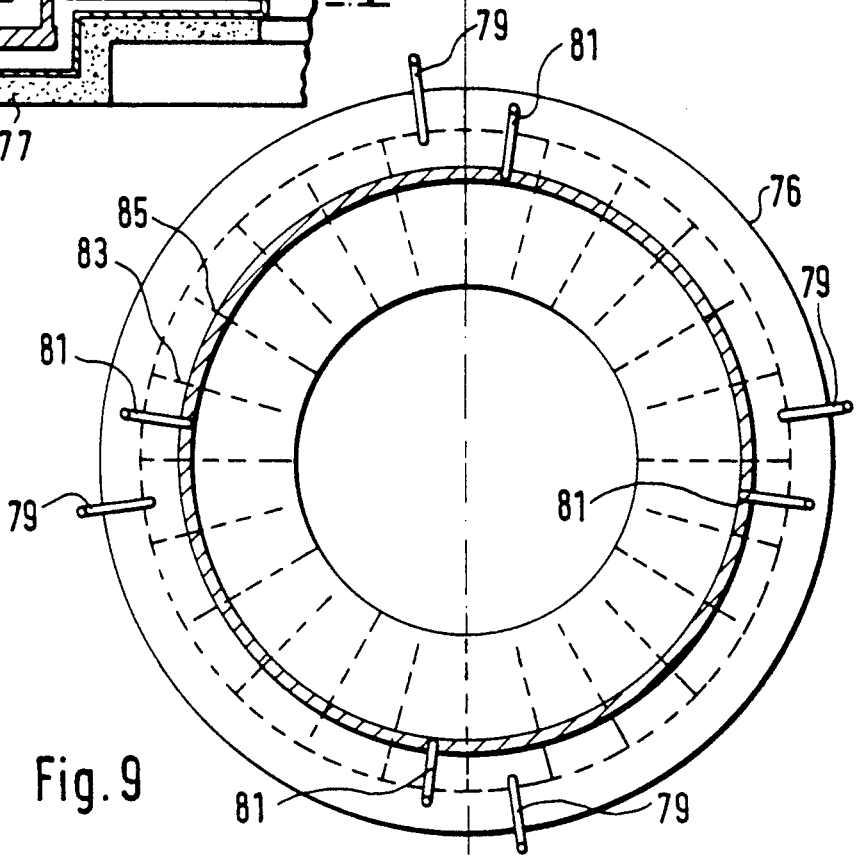
FIG. 9 is a horizontal section in the sectional plane IX—IX of FIG. 8.

In the embodiment illustrated in FIGS. 8 and 9, the cavity in the shield 76 is divided into several, in this particular case 4 segments, each equipped with an inlet 79 and an outlet 81 for a cooling fluid. The inner cavity of the shield possesses radial ribs 83 and 85 defining a serpentine path for the cooling fluid.

Moreover, a series of cylindrical thermal protection segments 78, 80, 82 is fastened to the inside of the ring 52 and extends vertically over the entire height of the two running rings 50, 52, with the exception of the segment 82 which must have a lower cross-section to allow the relative angular movements of the arm 68 for the pivoting of the chute 16. These protective segments which together with the running ring 52 and the chute 16 rotate about the axis 0, protect the running rings from the radiation coming from inside the furnace. This protection is advantageously completed by a cooling of the running rings. For this purpose, an annular cooling chamber 84, 86 (see FIGS. 4 and 8) is fastened on the inside of each of the bearing collars 46 and 48 and penetrates into the hollow cross-section of the running rings 50, 52. These chambers 84, 86 are likewise connected to a circuit for a cooling fluid, for example water. These chambers 84, 86 are preferably divided, in the manner of the shield 76, into several circular sections, each possessing an inlet 85 and an outlet 87 for cooling water and being equipped with partial internal partitions 89 to define the serpentine path of the cooling water.

The system for fastening the chute 16 between the two flanges 58 and 60 will now be described by reference to FIGS. 4 to 7. Each of the flanges 58, 60 has a groove 88 open upwards in the dismounting direction of the chute and widening slightly in this direction, as shown enlarged in FIG. 7, to make it easier to remove the chute. The chute 16 possesses two lateral pins 90, 92 of such design and dimensions as to be capable of sliding into the grooves 88 of each of the flanges 58 and 60 and of being retained at the bottom of these grooves. To prevent the chute 16 from pivoting relative to the flanges 58, 60, the chute has two additional lateral pins 94 and 95 wider than the pins 90 and 92. These pins 94 and 95 are likewise engaged into the grooves 88 of the flanges 58 and 60 when the other pair of pins 90, 92 is at the bottom of these grooves.

Figure 6:
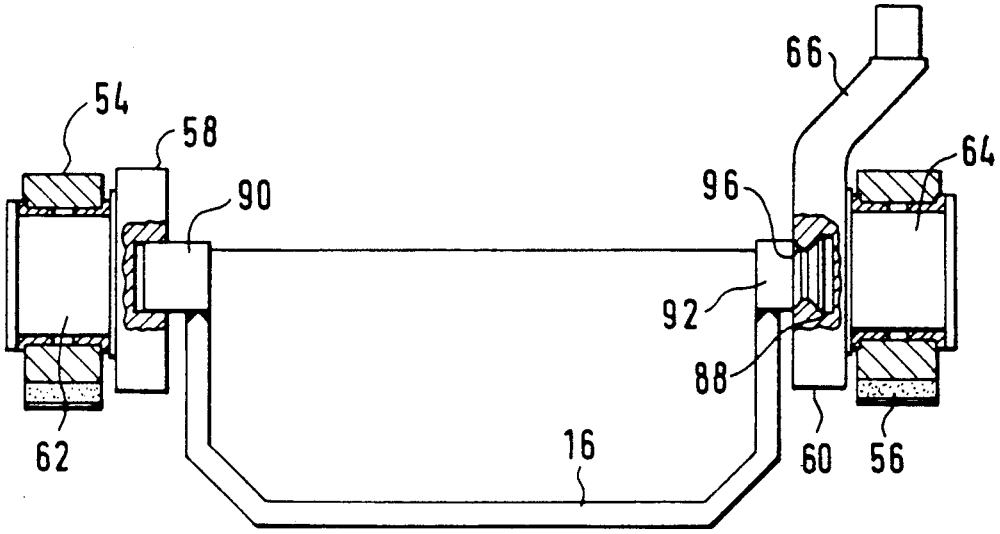
FIG. 6 is an enlarged view of part of FIG. 3, with details of the suspension and fastening of the chute.

To prevent a lateral play of the chute 16 in relation to the flanges 58, 60 the pins on one side preferably the pins 92 and 94, and the groove 88 of the corresponding flange 60 are profiled in a complementary way. As shown in FIG. 6, the pin 92 can have a circular flute 96 of the pin 92. The pin 90 opposite the profiled pin 92 must be straight in order to allow the relative movements arising as a result of thermal expansions.

Figure 7:
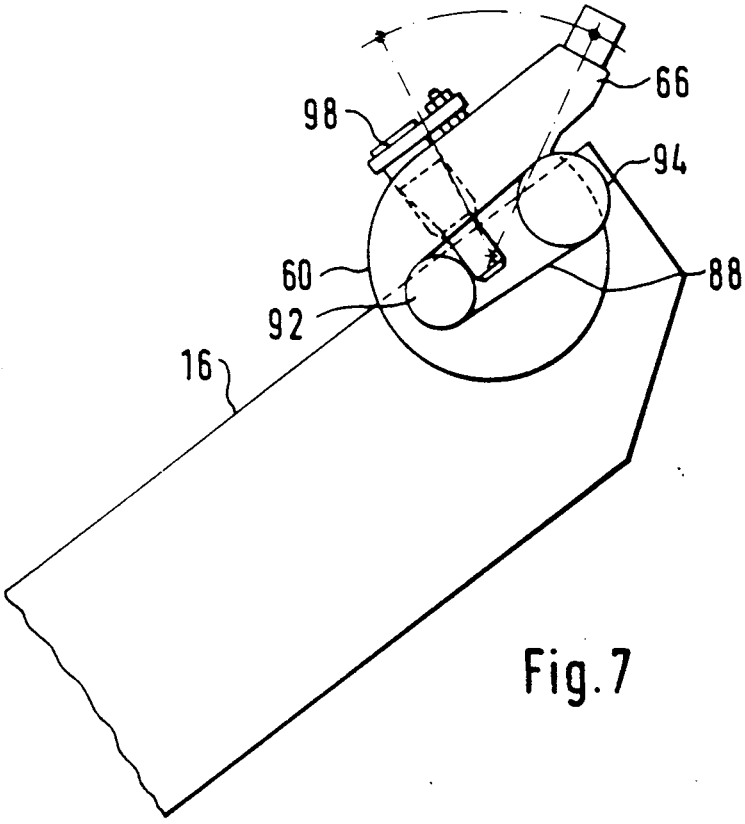
FIG. 7 shows the same details as FIG. 6 by means of an enlarged view of part of FIG. 4.
Figure 11:
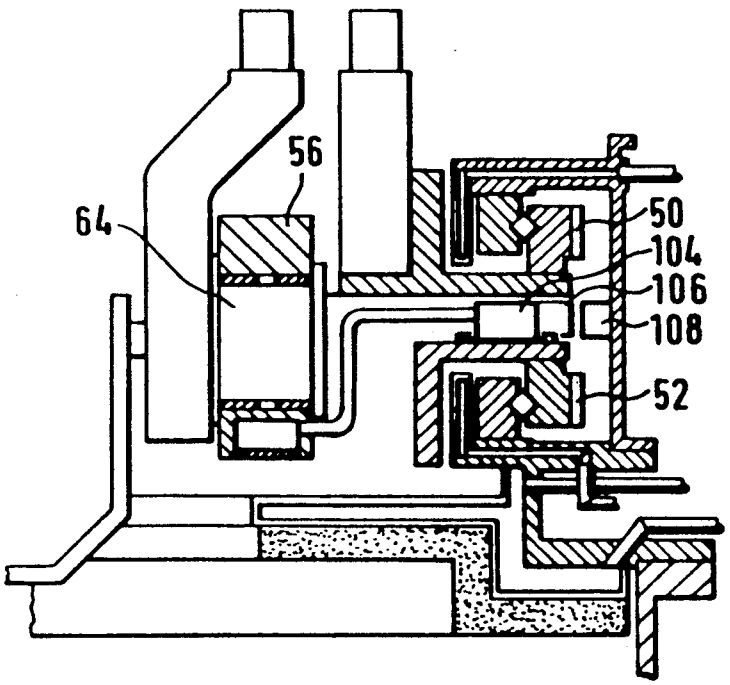
FIGS. 10 and 11 show diagramatically an embodiment of a system for cooling the suspension crossmembers of the chute, in vertical section along the respective sectional planes X—X and XI—XI of FIG. 12.

The chute 16 can therefore be retained in the grooves 88 of these two flanges 56 and 60 by means of its own weight and can be removed from them by sliding after the chute has been inclined in the direction of its removal. To prevent the chute 16 from being disconnected accidentally, for example in contact with the charging material in the furnace, it is possible to associate this fastening system with a locking means. As shown in FIG. 7, the two flanges 58, 60 can be designed so that it is possible to engage in them a gudgeon 98 which blocks the passage of the lower pins 90, 92 when these are located at the bottom of their grooves. In order to dismount the chute, it is therefore necessary to remove the locking gudgeons 98 beforehand.

Figure 10:
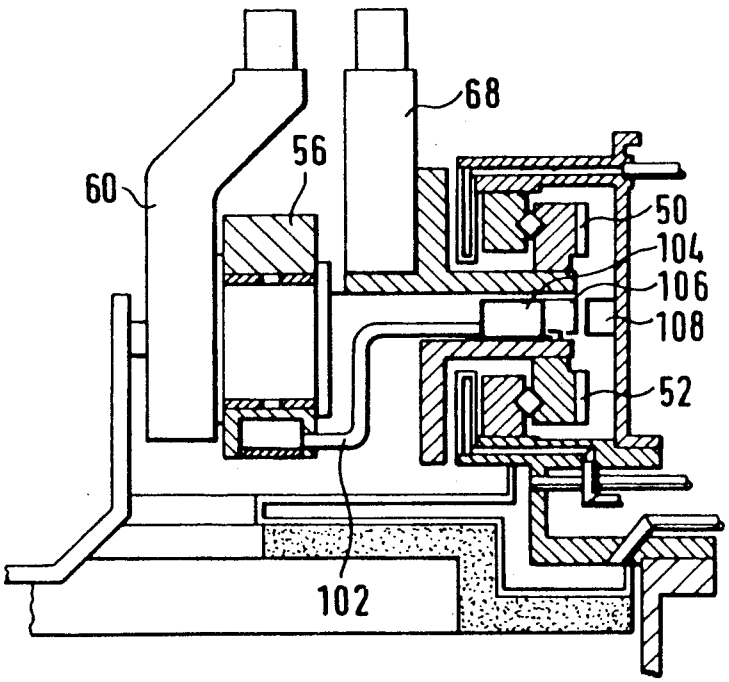
Figure 12:
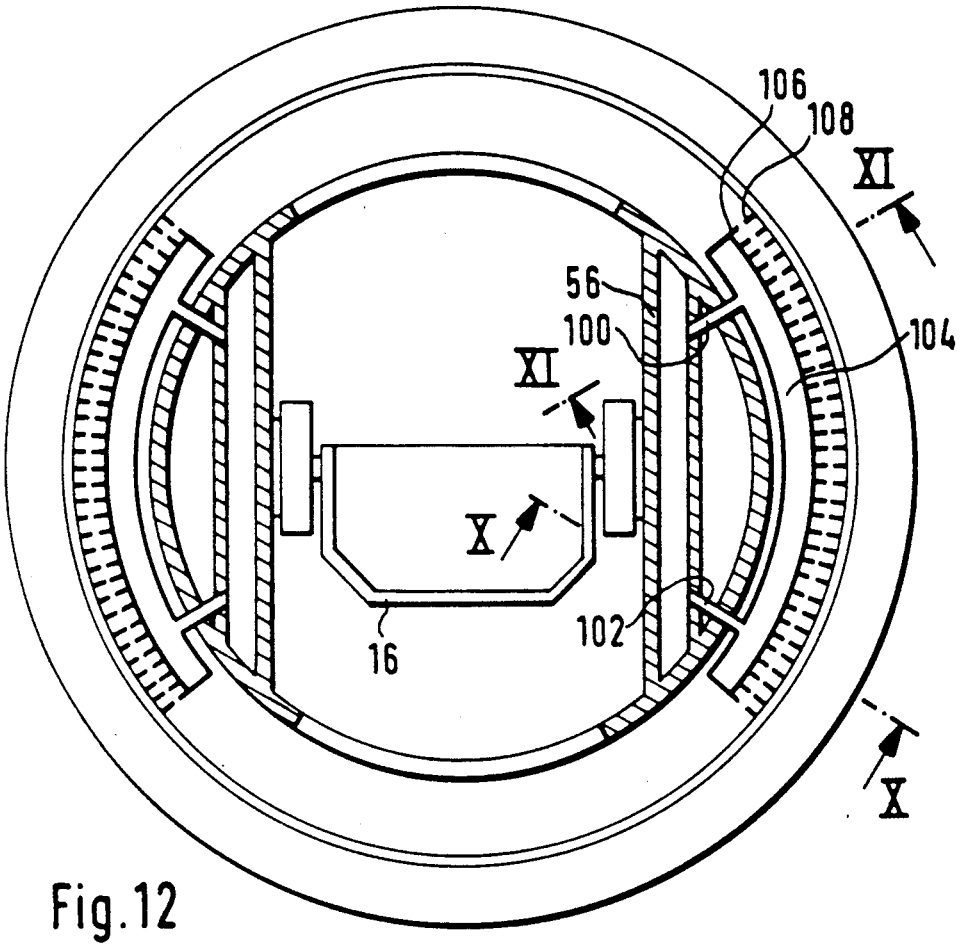
FIG. 12 shows diagramatically in horizontal section the system for cooling the suspension cross members in accordance with the present invention.

FIGS. 10 and 12 illustrate an advantageous system for cooling the two crossmembers 54 and 56 and more particularly the bearings in which the suspension journals 62 and 64 of the chute 16 pivot. Since the cooling systems of the two crossmembers 54 and 56 are identical, only that associated with the crossmember 56 will be described. As shown in the FIGURES, the lower part of the crossmember 56 is designed in the form of a hollow box in which a cooling fluid is located. This box communicates by means of two conduits 100, 102, with a chamber 104 which is fastened to the running ring 52 and which extends approximately over the entire length of the crossmember 56. The hollow part of the crossmember 56 is partially filled with a cooling fluid, such as water or preferably a cooling fluid, for example a sodium solution. The outer face of the chamber 104 and the inner face of the wall of the casing 15 have blades 106, 108 directed towards one another.

Under the effect of heat, the fluid contained in the crossmember 56 evaporates. This evaporation temperature must be below the limiting temperature allowing proper functioning of the drive mechanism and can be determined by the pressure in the closed circuit formed by the crossmember 56 and the chamber 104. The evaporated fluid passes into the chamber 104 via the conduit 102. In this chamber 104 which is at a temperature below the evaporation temperature of the fluid because of the large surface of the blades 106 and their rotation opposite the blades 108, the vapor condenses and returns to the crossmember 56 once again in liquid form via the conduit 102.

Automatic cooling of the crossmembers 54 and 56 without external involvement is thus obtained, the excess heat of the crossmembers being dissipated by means of the surface of the ring of blades 106.

To stimulate the circulation of the fluid, it is possible to inject into the space round the running ring 52 a cooled inert gas which can at the same time perform a sealing function by means of counterflow circulation.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for charging a shaft furnace with a flowable material comprising:

a cylindrical casing secured to the furnace, said casing having an inner surface;

a first ring rotatably secured to the inner surface of the casing for rotation about a vertical axis, said ring having an inner surface;

a second ring rotatably secured to the inner surface of the casing for rotation about the vertical axis;

a pair of crossmembers extending across the first ring and secured to the inner surface of the first ring;

a distribution chute pivotably suspended between the crossmembers at an angle of inclination relative to the vertical axis;

means for rotating the first ring;

means for rotating the second ring;

means for linking the chute with the second ring so that differential relative rotational movement between the first and second means changes the angle and inclination of the chute relative to the vertical axis;

a charging lock secured atop the casing, said lock having a first opening for introducing the material into the lock and a second opening for discharging material from the lock to the distribution chute; and valve means for metering flow of material from the second opening of the charging lock.

2. The apparatus of claim 1, further comprising:

a pair of opposed bearing means secured to the crossmembers for pivotably attaching to chute;

a pair of flanges supported by the bearing means;

wherein the chute is dismountably supported by the flanges.

3. The apparatus of claim 2, further comprising:

two pairs of opposed pins projecting outwardly from the chute; and two pairs of grooves on each flange wherein the chute is engaged with the flanges by sliding the pins into the grooves.

4. The apparatus of claim 3, wherein the pins have an outer surface profile, the grooves have an inner surface profile and the outer surface profile and the inner surface profile are complimentary.

5. The apparatus of claim 3, further comprising means for locking the pins in the grooves.

6. The apparatus of claim 2, wherein the means for linking comprises:

a first arm projecting from one of the flanges to a free end;

a second arm projecting from the second ring to a free end; and an articulated link connecting the free ends of the arms.

7. The apparatus of claim 1, further comprising:

an annular thermal protection shield secured between the furnace and the cylindrical comprising; and means for circulating a cooling fluid through the shield.

8. The apparatus of claim 7, wherein the shield is divided into separate circular sections and each section comprises a cooling fluid inlet, a cooling fluid outlet and a plurality of internal partitions defining a serpentine fluid path between the inlet and the outlet.

9. The apparatus of claim 1, further comprising:

a plurality of thermal protection segments secured to the inner surface of the first ring.

10. The apparatus of claim 1, further comprising:

a cylindrical thermal protection screen for each of the rings; and means for circulating a cooling fluid through the screens.

11. The apparatus of claim 10, wherein the screens are each divided into separate circular sections and each section comprises a cooling fluid inlet, a cooling fluid outlet, and a plurality of internal partitions defining a serpentine fluid path between the inlet and the outlet.

12. The apparatus of claim 1, further comprising:

means for evaporative cooling of the crossmembers, comprising:

an evaporation chamber with the crossmember;

a condensation chamber with the first ring; and means for allowing fluid flow between the chambers; and means for cooling the condensation chamber.

13. The apparatus of claim 12, wherein the means for cooling the condensation chamber comprises a plurality of blades projecting radially outwardly from the condensation chamber, and a plurality of blades projecting radially inwardly from the cylindrical casing.

14. The apparatus of claim 1, further comprising:

an annular support collar secured between the furnace and the cylindrical casing; and a valve cage secured between the cylindrical casing and the charging lock.

15. The apparatus of claim 1, further comprising:

a valve cage between the cylindrical casing and the charging lock said cage secured to th cylindrical casing;

compensation means for securing the charging lock of the valve cage;

means for supporting the charging lock, said means for supporting screws to the furnace; and load cell means for monitoring the contents of the charging lock, said load cell means being secured between the means for supporting and the charging lock.

* * * * *

UNITED STATES PATENT AND TRADEMARK OFFICE

CERTIFICATE OF CORRECTION

PATENT NO. : 5,022,806

DATED : June 11, 1991

INVENTOR(S) : Emile Lonardi, Giovanni Cimenti and Pierre Mailliet

It is certified that error appears in the above-identified patent and that said Letters Patent is hereby corrected as shown below:

| | |
|---|---|
| Col. 1, **line 40** | Delete "all" and insert therefore -- wall --. |
| Col. 3, **line 5** | Delete "ca" and insert therefore -- can --. |
| Col. 3, **line 40** | Between "section" and "the" insert -- of --. |
| Col. 4, **line 17** | Delete "of th" and insert therefore -- of the -- . |
| Col. 4, **line 50** | Delete "be" and insert therefore -- by --. |
| Col. 5, **line 56** | Delete "inclination f" and insert therefore-- inclination of --. |
| Col. 5, **lines 60-61** | The phrase "inclination of the chute 16 relative to the vertical" is repeated; delete the second occurance, which is in row 61. |
| Col. 8, **line 55** | Delete "complimentary" and insert therefore-- complementary --. |

UNITED STATES PATENT AND TRADEMARK OFFICE

CERTIFICATE OF CORRECTION

PATENT NO. : 5,022,806

DATED : June 11, 1991

INVENTOR(S) : Emile Lonardi, Giovanni Cimenti and Pierre Mailliet

It is certified that error appears in the above-identified patent and that said Letters Patent is hereby corrected as shown below:

Col. 8, line 68 After "cylindrical" insert -- casing --.

Col. 10, line 16 After "lock" insert --,--; also, delete "th" and insert therefore -- the --.

Signed and Sealed this

Twenty-ninth Day of June, 1993

*Attest:*

Michael K. Kirk

MICHAEL K. KIRK

*Attesting Officer*

*Acting Commissioner of Patents and Trademarks*